United States Patent [19]

Kuether et al.

[11] 4,160,292

[45] Jul. 10, 1979

[54] BATH CHAIR

[76] Inventors: Christian L. Kuether, 1516 Oakdale, Houston, Tex. 77004; Edith L. Kuether, 3708 Stewart Dr., Chevy Chase, Md. 20015

[21] Appl. No.: 916,358

[22] Filed: Jun. 16, 1978

Related U.S. Application Data

[63] Continuation of Ser. No. 800,024, May 24, 1977, abandoned.

[51] Int. Cl.[2] ..... A47K 3/022

[52] U.S. Cl. ..... 4/146; 4/175; 4/181; 4/182; 4/185 S; 128/66

[58] Field of Search ..... 4/146, 175, 181, 182, 4/173, 177 R, 148, 160, 150, 185 S; 128/66; D23/55

[56] References Cited

U.S. PATENT DOCUMENTS

| | | | |
|---|---|---|---|
| 3,562,821 | 2/1971 | Queen | 4/175 |
| 3,616,467 | 11/1971 | Drain | 4/146 |
| 3,662,409 | 5/1972 | Johansson | 4/173 |

*Primary Examiner*—Lenard A. Footland

*Attorney, Agent, or Firm*—Berman, Aisenberg & Platt

[57] ABSTRACT

For more easily and comfortably bathing invalids, a chair having a substantially horizontal seat, a semi-cylindrical wall extending upwardly from the seat for closely surrounding the back and sides of the invalid, the upper edge of the semi-cylindrical wall being inclined downwardly and forwardly to the level of the seat and being curled forwardly and inwardly to form a channel with an inturned lip, a spray tube with bottom openings in the channel for directing water downwardly along the back and sides, and the arms and thighs of a seated invalid, a deep well reservoir surrounding the seat and connecting the seat and the semi-cylindrical wall, a shallow foot-pan below and forward of the seat and whose rim is extended upwardly at the rear to join the front of the seat, the forward edge of the rim being well below the level of the seat to permit easy ingress of an invalid, a valve controlled drain passage leading from the deep well reservoir to the foot pan, and means for supplying wash water independently to the spray tube and foot pan. In another embodiment the seat of the chair is removable and replaceable by the same or another seat.

19 Claims, 9 Drawing Figures

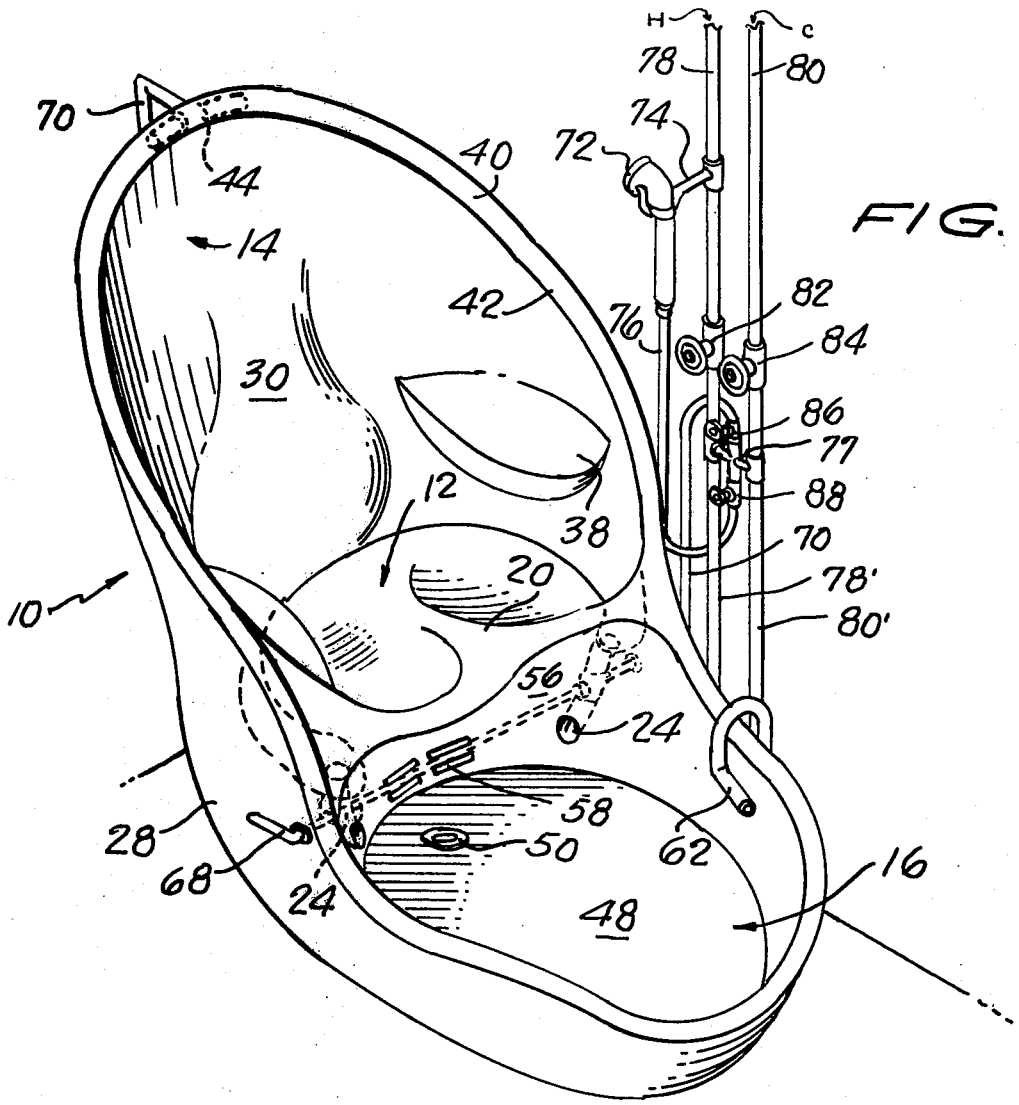
FIG. 1.
FIG. 2.
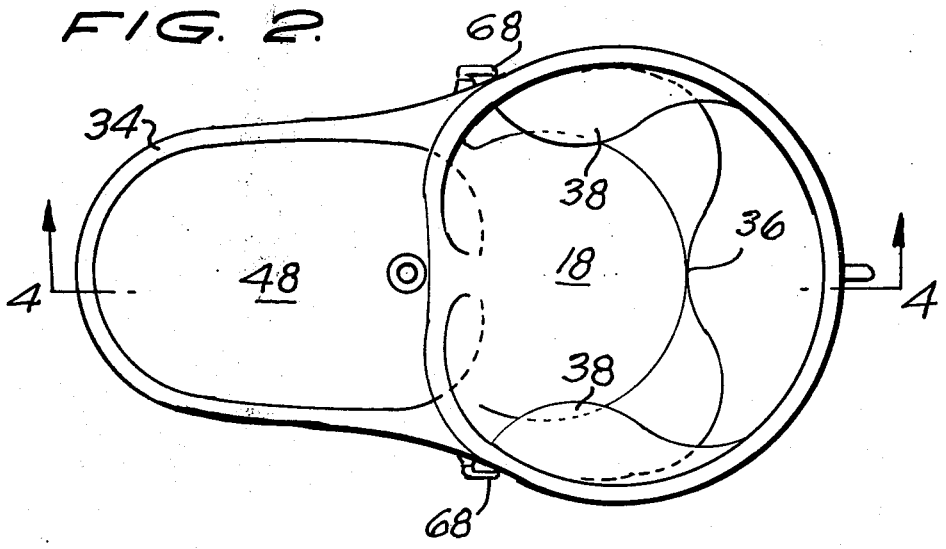

FIG. 7.
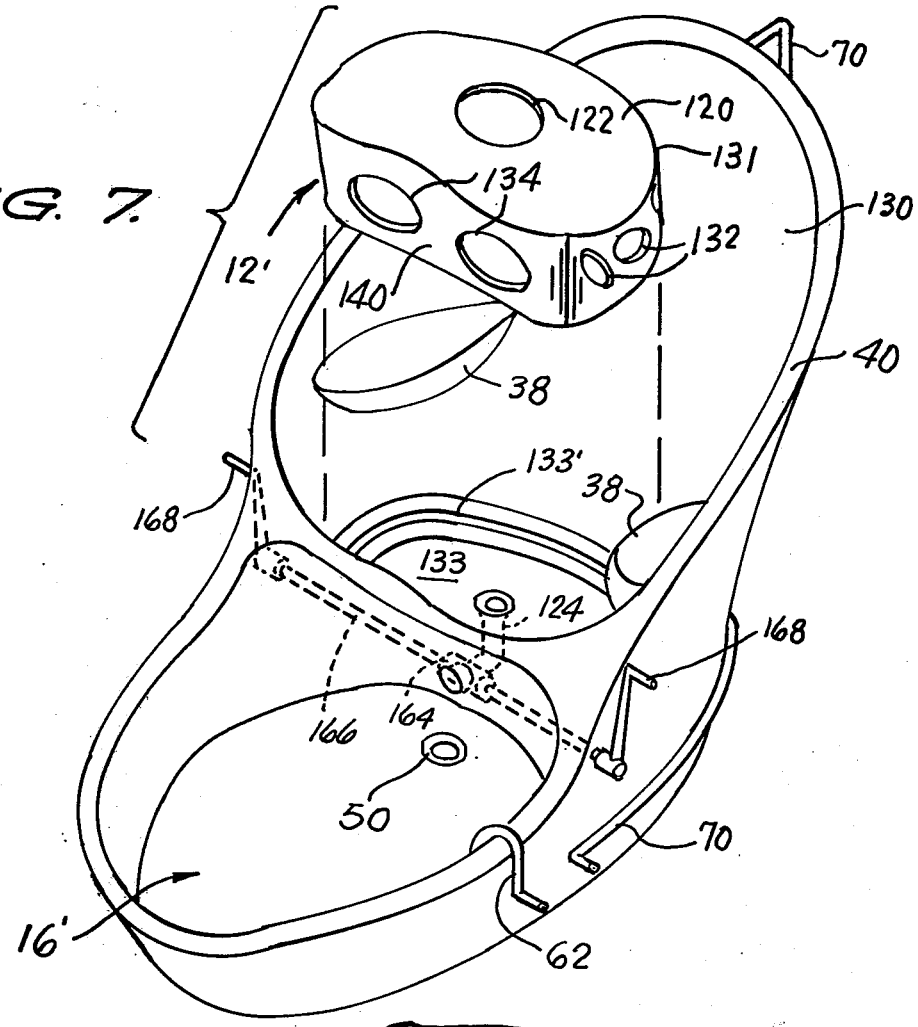
FIG. 8.
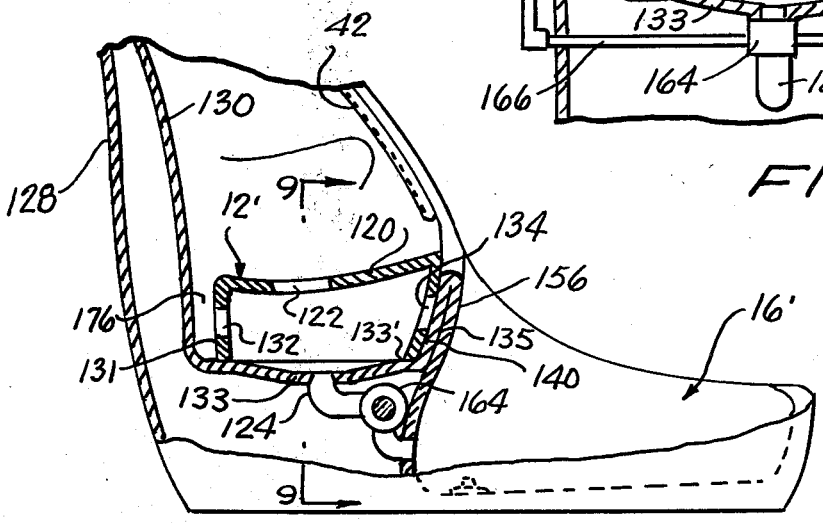
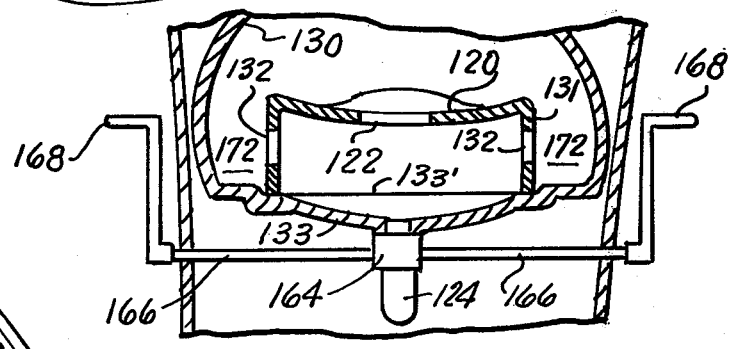
FIG. 9.

BATH CHAIR

This is a continuation of application Ser. No. 800,024, filed May 24, 1977, now abandoned.

BACKGROUND OF THE INVENTION

Physically handicapped or incapacitated people have difficulty in bathing because typical shower stalls require them to stand erect, while conventional tubs require climbing over a high rim to enter and leave. While various chairs and cabinets have been specially designed for use by invalids, these have numerous disadvantages, as for example; they may be as difficult to enter and leave as a conventional bath tub; they often require two attendants to assist the invalid, to wash him and to manipulate the controls; they fail to comfortably support the seated patient in a stable manner during washing, engendering fear of toppling and falling in the patient; they spray and splash water directly upon the patient with considerable force increasing his fear and insecurity; they do not permit still-pool washing as well as washing by continuous flow of water; and they do not permit of separately and independently washing the torso and leg portions of the patient's body in such manner as to prevent cross infection.

SUMMARY OF THE INVENTION

Briefly described, the present invention overcomes the above-mentioned defects and disadvantages of known bathing devices by providing a bath chair having a horizontal seat and a semi-cylindrical back wall which closely surrounds the back and sides of the invalid without unduly confining him. The upper edge of the semi-cylindrical wall lies in a plane inclined downwardly and forwardly to the level of the seat and is curled forwardly and inwardly to form a channel with an inturned lip which houses a spray tube. Thus a continuous stream of warm water may be sluiced along the back and sides, the arms and thighs of the seated patient rather than sprayed and splashed directly against him. A deep well reservoir surrounding the sides and rear of the seat connects the seat to the semi-cylindrical wall. The reservoir about the seat confines still wash water for application to the body parts by cloth or sponge. A shallow foot pan is disposed below and in front of the seat with the rear portion of its rim extended upwardly and connected to the front of the seat or its supporting chamber. The front portion of the rim is very low and well below the level of the seat, so that it is easy for the patient to step into the pan for seating in the chair, or to be assisted or lifted over the rim if he is non-ambulatory. The reservoir has a valve controlled drain passage to the foot pan, and means is provided for supplying water independently to the spray tube and foot pan. The described structure permits the upper body and the feet and legs of the patient to be washed by a constant flow of water, or the upper torso to be washed independently of the leg and foot portions. Alternatively, the upper body may be bathed while the feet and legs are kept dry as is useful in cases of leg and foot surgery.

Thus, it is a primary object of the invention to provide a bath chair which permits easy ingress and egress of an invalid.

Another important object of the invention is to provide a bath chair having a back of curved contour which comfortably supports an invalid in a stable manner and in a normal seated position, and which directs a flow of warm wash water along the back, sides, arms and thighs minimizing direct force impingement of water spray on the body and eliminating splashing.

A further object of the invention is to provide a bath chair, having the the above briefly-described characteristics, which enables bathing with either still water or constantly running water, and which permits the upper portions of the body to be washed independently of the legs and feet so that parts of the body may be kept dry while other parts are washed.

A still further object of the invention is to provide a bath chair having a removable seat, thus permitting simple and convenient interchange of seats, for example, for hygienic reasons as in nursing homes, or to provide different specific seat designs as may be required for specific therapeutic bathing of lower portions of the torso.

BRIEF DESCRIPTION OF THE DRAWINGS

The novel features that are considered characteristic of the invention are set forth with particularity in the appended claims. The invention itself, however both as to its organization and its method of operation, together with additional objects and advantages thereof, will best be understood from the following description of a specific embodiment when read in connection with the accompanying drawings, wherein like reference characters indicate like parts throughout the several figures and in which:

FIG. 1 is a front perspective view of the bath chair according to the invention as installed with visible water supply plumbing;

FIG. 2 is a plan view of the bath chair of FIG. 1 with the plumbing omitted;

FIG. 7 is a perspective view of a second embodiment of the chair alone showing a removable seat in exploded position;

FIG. 8 is a fragmentary side elevation of the chair of FIG. 7 with parts broken away to reveal the seat and adjacent portions in section; and FIG. 9 is a cross-sectional view through the seat portion of the chair taken on line 9—9 of FIG. 8, and looking in the direction of the arrows.

DESCRIPTION OF THE PREFERRED EMBODIMENTS

Referring now in more detail to the drawings, the bath chair according to the invention is generally referenced by numeral 10 and comprises a seat portion 12, a back portion 14 and a foot pan 16. The size, shape and arrangement of parts are such that the chair resembles an easy chair in which the patient sits upright in a normal posture conducive to feelings of comfort, support, freedom of movement and pleasure. The front of the chair being open, there is freedom for movement of the patient's arms, legs, shoulders and feet preventing the frightening feeling engendered by confinement. The chair may be fabricated, in one or more pieces, by moulding or casting a plastic material, such as a polyester resin reinforced with fiberglass polyolefin, or like material. Such materials present smooth yet non-slippery, warm, sanitary surfaces which are easy to clean and feel soft to the body.

Figure 4:
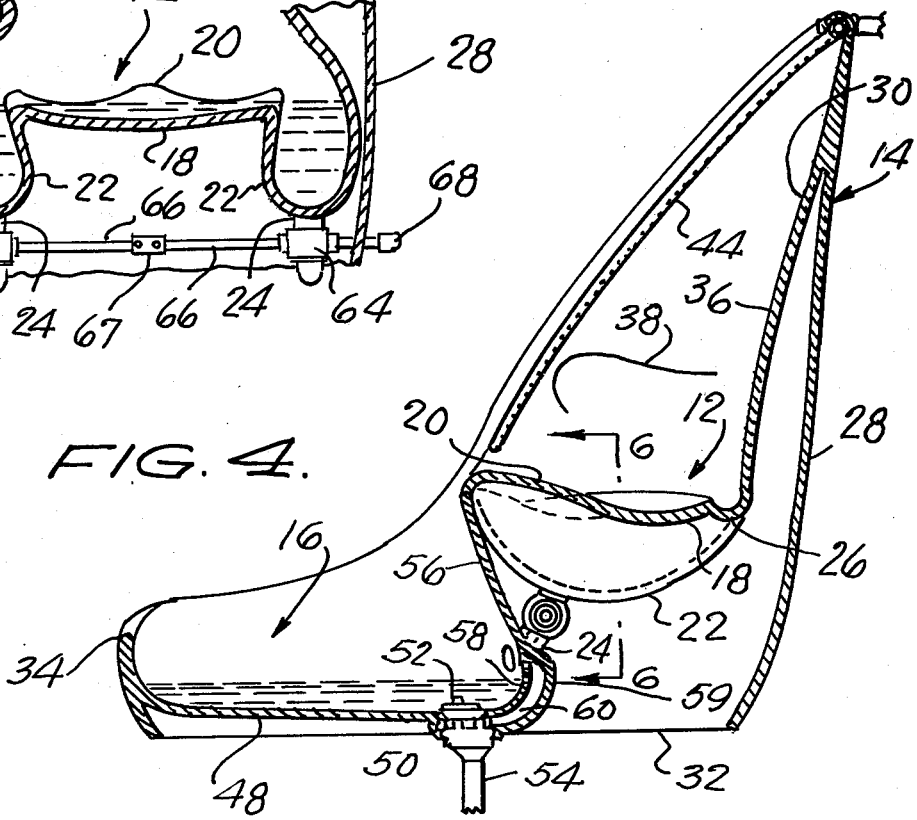
FIG. 4 is a sectional view taken along line 4—4 of FIG. 2 and looking in the direction of the arrows.

The seat 12 is saddle shaped being generally concave at 18 and having a convex upper protuberance 20 at the front center for separating the legs of the invalid, or patient, seated thereon. A pair of deep pockets 22, 22 are formed at the sides of seat 12 and which are deeper at the front than at the rear, see FIGS. 4 and 6. Drain passages, 24, 24 extend downwardly from the lowest portions of the wells and open into the foot pan 16. A shallow trench 26 joins the upper portions of pockets 22, 22 extending laterally across the rear of seat portion 18. When the drains 24, 24 are closed, the pockets 22, 22 and trench 26 form a deep well reservoir of still bath water which may be applied to the patient by sponge or cloth.

The back portion 14 of the chair is of integral double wall construction being formed of a pair of outer and inner semi-cylindrical walls 28 and 30 respectively, which are joined at their upper edges. The lower edge 32 of the outer wall is horizontal and forms a level base for supporting the chair on a floor. The lower forward, side portions of the outer wall are extended forwardly to merge with and form the rim 34 of foot pan 16.

The inner-cylindrical wall 30 is concave in its upper part to closely surround and support the back and shoulders of the patient. However, the lower central portion of wall 30 is formed with a vertical, forwardly projecting, convex rib 36 which comfortably supports the small of the back, or lumbar region, of the patient. A pair of arm rests 38, 38 project inwardly from the sides of wall 30 for supporting the elbows and forearms of the patient. The inner semi-cylindrical wall 30 extends upwardly at its central portion to a level above the shoulders of a patient, and the upper edge lies in a curved plane inclined downwardly and forwardly to about the level of the front of seat 12. The edge is curled forwardly and inwardly to form a channel 40 with an inturned lip 42. Within channel 40 is secured a U-shaped spray tube 44 having downwardly directed spaced spray openings 46. The inturned wall lip 42 prevents inward flow of wash water and direct impingement on the body of the patient so that the spray from tube 44 flows downwardly as in a sluice confined between the back shoulders and arms of the patient and the inner-surface of semi-cylindrical wall 30.

The foot pan 16 is quite shallow, the top of the rim 34 sloping downwardly and forwardly with its front portion being considerably below the level of seat 12, so that the patient may easily step over the rim either into or out of the pan. The bottom wall 48 of the pan is just above the floor level and slopes slightly downward toward the rear in which portion is drain opening 50 with removeable stopper 52. The opening 50 connects with a drain pipe 54. The rear wall portion 56 of the rim of foot pan 16 extends upwardly to the level of seat surfaces 18, 20 and is integrally joined thereto. The reservoir drain passages 24, 24 open through wall 56. In addition, a plurality of overflow openings 58 are formed through rimwall 56, and these are connected to drain opening 50 and pipe 54 by a passage 60 formed between rim wall 56 and a second and inner wall 57. A water inlet pipe 62 to the foot pan 16 is best shown in FIG. 1.

Figure 3:
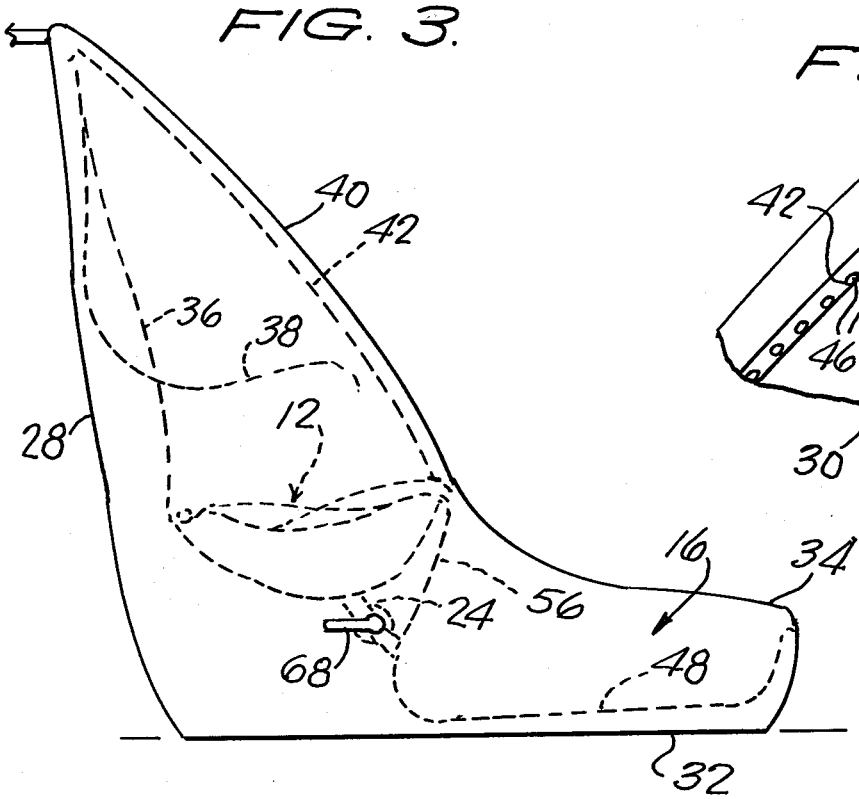
FIG. 3 is a side elevational view of the bath chair alone.
Figure 5:
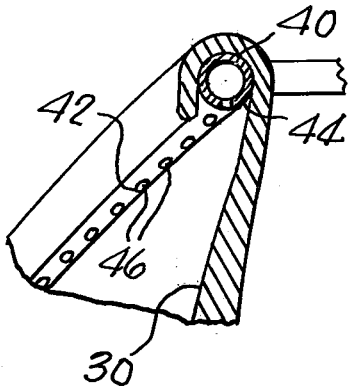
FIG. 5 is an enlarged, perspective, cross sectional view showing the channel at the upper edge of the semi-cylindrical back wall of the chair which houses the spray tube.
Figure 6:
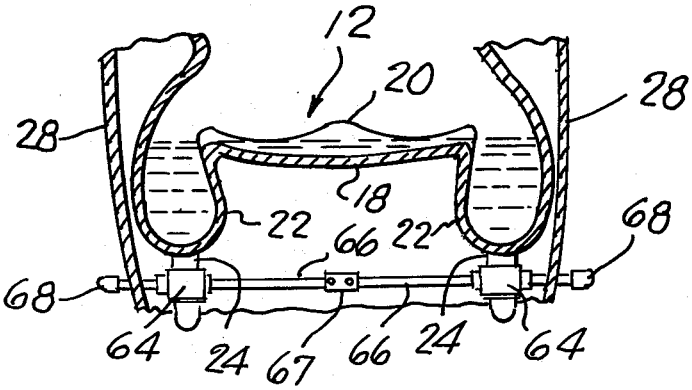
FIG. 6 is a cross-sectional view through the seat portion of the chair taken on line 6—6 of FIG. 4, and looking in the direction of the arrows.

Each of the drain passages 24, 24 is controlled by a valve 64 mounted on a pair of aligned shafts 66 which extend outwardly through journal openings in the outer wall 28, as best seen in FIG. 6. The shafts are centrally journalled at 67. A lever 68 for turning the valves 64, 64 is provided at each side of the chair within easy reach of the patient. Obviously, the shafts may be coupled together to be turned simultaneously by one lever if desired. The spray tube 44 is fed water of adjusted temperature through conduit 70 connected to the tube 44 at its central uppermost point. A telephone type shower head 72 is removeably clamped in bracket 74, and is fed water through a conduit 76.

While the means for supplying water at the proper temperature to the bath chair is not an important part of the present invention, one possible fixed installation is illustrated in FIG. 1, it being understood that the piping may be installed behind a wall, not shown, and that the bath chair may be moved to other locations where a different or similar water supply may be temporarily or permanently connected. In the illustrated plumbing, pipes 78 and 80 are hot and cold water supply pipes, controlled by valves 82, 84 respectively, for adjusting the proportions so that a mixture of suitable temperature flows in the X-shaped connecting pipe 77 and in the lower pipe portions 78' and 80' below the valves, and which lower pipe portions are connected to one another by a U-fitting at their bottoms not shown. The conduit 70 leading to spray tube 44 is connected by a fitting to pipe 77 and in which is placed a control valve 86. The flexible conduit 76 is connected to pipe 77 by a fitting in which is placed a control valve 88. The foot pan inlet pipe 62 is connected to both pipes 78', 80' by the previously mentioned U-fitting in which is placed another control valve, not shown. It will be apparent that regulating valves 82, 84 will adjust the temperature of water in the connected pipe portions 77, 78', 80'. Regulation of valve 86 and 88 will serve to feed the mixed, warm water to either or both the spray tube 44 and shower head 72. Regulation of the other valve, not shown, will feed warm water to foot pan 16 through inlet pipe 62.

OPERATION

If the patient is ambulatory he simply steps over the front part of rim 34 into the foot pan 16, turns around, removes his robe and sits down in seat 12. If the patient is not ambulatory, a single attendant may help him to step over the low foot pan rim or lift him over without having to swing him up and over a high barrier as with a conventional bath tub. Entry and egress of the bath chair is no more difficult than helping an invalid into or out of an easy chair.

Once seated in the chair, the patient, or his attendant, may regulate the valves 82, 84 to adjust the temperature and then turn valve 86 to direct a flow of warm water from spray tube 44 down the back and sides of wall 30, through pockets 22, 22, drains 24, 24 and down the back 56 of the foot pan 16 into drain opening 50. The warm running water sluices along the back, shoulders and arms of the patient keeping him warm and comfortable. During this flow a pool is formed in the pockets 22, 22, trench 26 and concave seat surface 18. The flow of water may be stopped by turning valve 86. The drain passages 24, 24 may be closed by valves 64, 64 under control of levers 68, 68 whereupon the seat section becomes a bidet for still bathing and cleansing of the perineum. This is especially valuable in cases of hemorrhoidsectomy, dysmenorrhea and post-partum therapy.

By closing the valves 64, 64 before initiating the spray of water from tube 44, the water is trapped in pockets 22, 22 and is confined to the upper body portions, keeping the feet and legs dry. This is important for patients after leg and foot surgery.

Alternatively, the upper chair parts fed by spray tube 44 may be kept dry and water fed only through pipe 62 to the foot pan 16. With sponge or cloth the patient may then give himself, or be given, a foot bath.

If and when desired valve 88 may be regulated and shower head 72 manipulated to direct a shower spray to any part of the body including the head and hair for shampooing the latter.

From the above, it will be readily apparent that the invention is useful for cleansing of all body surfaces by either constant water flow or still water pool bathing (by closing drains). The drain valves for the pockets at both sides of the seat may, if desired, be modified to be simultaneously operated thus adding to the versatility. The ability to wash portions of the body while keeping other portions dry eliminates the danger of infection traveling from one area to another, or the spread of fungus, as in athlete's foot, and as is highly desirable for persons with special medical and surgical proscriptions such as following certain kinds of surgery.

If the patient is exceptionally infirm a seat belt and shoulder strap obviously can be added to keep him from sliding or falling forward.

By installing a whirlpool automator in the foot pan, patients with circulatory problems in legs and feet may be treated with whirlpool action in the foot bath while the upper parts of their bodies seated in the chair remain dry and normally clothed.

A modified embodiment of the chair having a replaceable seat is illustrated in FIGS. 7–9. The modified chair is in all structural respects as well as mode of use and operation identical with the previously described embodiment except as explained below.

The semi-cylindrical wall for supporting the back and sides of the patient is similar in shape and size, has inturned lip 40 housing spray tube 42 and is composed of inner wall 130 and outer wall 128 as in the first embodiment. Inner wall 130 is carried forward and centrally by a concave bottom 133 having a horizontal, flat peripheral ledge 133' for supporting the removable and replaceable seat 12'. The front of bottom 133 is extended upwardly in portion 135 and then rolled to extend downwardly in wall 156 which blends with the sides and bottom of and forms the rear wall of foot pan 16'. A drain opening in the lowest part of bottom 133 is connected by an angular drain pipe 124 to an opening in foot pan wall 156. Flow of water through drain pipe 124 is controlled, off or on, by valve 164 installed in the pipe and whose condition is determined by manipulation of either level 168, 168 and connected shafts 166, 166.

The removable seat 12' has an upwardly facing concave top surface 120, with a saddle shape, if desired, and drain opening 122. A substantially semi-cylindrical or oval wall 131 and a substantially planar front wall 140 are connected to top surface 120 to complete the removable seat 12'. The dimensions of the seat are such that it may be lifted vertically between arm rests 38,38, without tilting to remove the seat and may be replaced on supporting ledge 133' by reversing this movement. If desired a different seat having similar overall dimensions may be substituted.

The seat rear wall 131 is provided with a plurality of drain openings 132, and the forward wall has similar, but larger, openings 134. As will be seen from FIGS. 8 and 9, a deep well reservoir comprised of side pockets 172,172 and rear pocket 176 is formed about seat 12' and between its wall 131 and the inner wall 130 of the chair. If desired the seat 12' may be configured and dimensioned to form a pocket between front wall 14 and wall 135 thus enlarging the reservoir to extend completely around the seat. The reservoir is filled to a level above the seat for washing the waist and perineum by closing valve 164. Upon opening this valve, water passes to the interior of seat 12' through openings 132, 134 and drains into the foot pan 16' through pipe 124.

It will be readily apparent that the provision of a removable and replaceable seat 12' offers great hygienic advantage where many persons use the same bath chair, and where different patients require different specific seat designs for therepeutic bathing of the lower torso.

Although certain specific embodiments of the invention have been shown and described, it is obvious that many modifications thereof are possible. The invention, therefore, is not intended to be restricted to the exact showing of the drawings and description thereof, but is considered to include reasonable and obvious equivalents.

What is claimed is:

1. A bath chair, particularly for invalids, comprising: a substantially horizontal seat; a semicylindrical wall extending upwardly with respect to said seat for closely surrounding the back and sides of an invalid, the upper edge of said semi-cylindrical wall lying in plane inclined downwardly and forwardly to the level of said seat and said edge being curled forwardly and inwardly to form a channel with an inturned lip; a spray tube having openings in its bottom seated in said channel for directing water downwardly along the back and lateral surfaces of the body and the arms and thighs of an invalid seated in the chair; a deep well reservoir formed around and below said seat and separating said seat from the semi-cylindrical wall; a shallow foot pan disposed below and forward of the seat and having a rim whose rear portion is extended upwardly adjacent to the front of the seat, the forward edge of said rim being well below the level of said seat; a drain opening in said foot pan; a drain passage leading from said deep well reservoir to said foot pan, a valve in said passage; and means for supplying wash water independently to said spray tube and foot pan.

2. A bath chair comprising: a seat, an upstanding wall for closely surrounding a bather when seated in said seat, the upper edge of said wall being curled to form a channel with an inturned lip, a spray tube in said channel for directing water inwardly and downwardly with respect to said wall, a deep well reservoir adjacent said seat, a foot pan disposed below and forward of said seat, a drain passage leading from said deep well reservoir to said foot pan, said passage having valve means, and means for supplying wash water to said spray tube.

3. A bath chair according to claim 1, wherein said seat, semi-cylindrical wall and foot pan are of one piece construction.

4. A bath chair according to claim 3, wherein said seat, semi-cylindrical wall and foot pan are formed of a plastic material.

5. A bath chair according to claim 1, wherein said semi-cylindrical wall has a forwardly projecting convex portion at its lower central part to support the lumbar region of an invalid seated in the chair.

6. A bath chair according to claim 5, wherein seat has an upwardly projecting convex portion at its forward, center part, said reservoir comprising a pair of deep pockets at the sides of the seat and a shallow trench joining the tops of said pockets across the rear of the seat.

7. A bath chair according to claim 6, wherein said pockets at the sides of the seat have deeper front portions than rear portions, and said drain passage includes a pair of conduits leading from said front portions to openings in the rear wall portion of said foot pan rim.

8. A bath chair according to claim 7, wherein a valve is placed in each of said conduits, each valve having a control rod and a lever for manually turning the rod from a side of said chair.

9. A bath chair according to claim 8, wherein said drain opening is in the bottom wall of said foot pan, and overflow openings are provided in the rear wall of said foot pan, said overflow openings being connected by a passage external of the path to said drain opening.

10. A bath chair according to claim 6, wherein said semi-cylindrical wall is a double wall having an inner and outer wall joined along said upper edge, said seat being joined outwardly of said pair of wells and shallow trench to said inner wall, said outer wall at its lower forward portion being extended forwardly to form the side and front portions of the rim of said foot pan.

11. A bath chair according to claim 1, wherein said semi-cylindrical wall is provided with inwardly projecting arm rests at the sides thereof.

12. A bath chair according to claim 1 or 2, in combination with a shower head connected by a flexible tube to said means for supplying wash water.

13. A bath chair according to claim 1 or 2, wherein said seat is removable and replaceable.

14. A bath chair according to claim 13, wherein said semi-cylindrical wall has a concave bottom with a flat, peripheral ledge, said removable seat has a substantially horizontal upper surface, a substantially semicircular rear wall, and a substantially planar front wall, said rear and front walls being seated for removal on said ledge.

15. A bath chair according to claim 14, wherein said rear wall of the seat is spaced from the semi-cylindrical wall to form a deep well reservoir surrounding the rear and sides of the seat.

16. A bath chair according to claim 15, wherein said drain passage leading from the reservoir includes drain openings found in the top surface, rear and front walls of the seat permitting flow into the interior thereof, and a valve controlled pipe leading from the concave bottom of the semi-cylindrical wall under the seat to said foot pan.

17. The bath chair according to claim 2, wherein said wash water supply means includes means for supplying wash water to said foot pan.

18. The bath chair according to claim 2, wherein said upstanding wall has an opening located between said seat and said foot pan.

19. The bath chair according to claim 2, wherein said upper edge of the upstanding wall is inclined downwardly and forwardly to the level of said seat.

* * * * *